US009781515B2

(12) United States Patent
Shibuya et al.

(10) Patent No.: US 9,781,515 B2
(45) **Date of Patent: *Oct. 3, 2017**

(54) LOUDSPEAKER DIAPHRAGM, AND LOUDSPEAKER, ELECTRONIC DEVICE AND MOBILE DEVICE INCLUDING THE DIAPHRAGM

(71) Applicant: Panasonic Intellectual Property Management Co., Ltd., Osaka (JP)

(72) Inventors: Tomonori Shibuya, Okayama (JP); Yoshiyuki Takahashi, Okayama (JP); Yoshimichi Kajihara, Okayama (JP); Tetsushi Itano, Okayama (JP); Mitsukazu Kuze, Okayama (JP); Takayuki Dan, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/023,684

(22) PCT Filed: Aug. 21, 2015

(86) PCT No.: PCT/JP2015/004194

§ 371 (c)(1),
(2) Date: Mar. 22, 2016

(87) PCT Pub. No.: WO2016/038813

PCT Pub. Date: Mar. 17, 2016

(65) Prior Publication Data

US 2016/0212540 A1 Jul. 21, 2016

(30) Foreign Application Priority Data

Sep. 8, 2014 (JP) ..... 2014-181936

(51) Int. Cl.
*H04R 1/00* (2006.01)
*H04R 7/06* (2006.01)
(Continued)

(52) U.S. Cl.
CPC ..... *H04R 7/06* (2013.01); *H04R 7/125* (2013.01); *H04R 9/06* (2013.01); *H04R 9/045* (2013.01);
(Continued)

(58) Field of Classification Search
CPC ..... H04R 7/06; H04R 2307/021; H04R 2307/029; H04R 7/122; H04R 7/125
See application file for complete search history.

(56) References Cited

U.S. PATENT DOCUMENTS 4,674,592 A * 6/1987 Aoki ..... H04R 7/02 181/170
5,274,199 A * 12/1993 Uryu ..... H04R 7/02 181/169
(Continued)

FOREIGN PATENT DOCUMENTS

JP 4-340896 11/1992
JP 5-007393 1/1993
(Continued)

OTHER PUBLICATIONS

International Search Report of PCT application No. PCT/JP2015/004194 dated Sep. 15, 2015.

*Primary Examiner* — Curtis Kuntz
*Assistant Examiner* — Ryan Robinson
(74) *Attorney, Agent, or Firm* — McDermott Will & Emery LLP

(57) ABSTRACT

A loudspeaker diaphragm includes a base layer and a coating layer. The base layer contains natural fibers. The coating layer is composed of bamboo cellulose nanofibers and is
(Continued)

formed at least on the first side of the base layer. The coating layer has a thickness in the range of 3% to 15%, both inclusive of the sum of the thicknesses of the base layer and the coating layer.

11 Claims, 6 Drawing Sheets

(51) Int. Cl.
*H04R 9/06* (2006.01)
*H04R 7/12* (2006.01)
*H04R 9/04* (2006.01)

(52) U.S. Cl.
CPC .. *H04R 2307/021* (2013.01); *H04R 2307/029* (2013.01); *H04R 2499/11* (2013.01); *Y10S 977/796* (2013.01)

(56) References Cited

U.S. PATENT DOCUMENTS 5,473,121 A * 12/1995 Uryu ..... H04R 7/125 181/169
8,343,313 B2 * 1/2013 Mimura ..... D21J 3/00 162/21
9,438,997 B2 * 9/2016 Jin ..... H04R 7/06
2006/0266577 A1 * 11/2006 Inoue ..... H04R 7/10 181/167
2008/0053745 A1 * 3/2008 Tada ..... H04R 1/24 181/165
2010/0296688 A1 * 11/2010 Funahashi ..... H04R 7/125 381/398
2011/0091053 A1 * 4/2011 Iseki ..... H04R 7/06 381/191
2015/0167231 A1 * 6/2015 Semba ..... C08L 1/02 525/54.23

FOREIGN PATENT DOCUMENTS

JP 2013-042405 2/2013
WO 2015/011903 1/2015

* cited by examiner

LOUDSPEAKER DIAPHRAGM, AND LOUDSPEAKER, ELECTRONIC DEVICE AND MOBILE DEVICE INCLUDING THE DIAPHRAGM

This application is a U.S. national stage application of the PCT international application No. PCT/JP2015/004194.

TECHNICAL FIELD

The present disclosure relates to a loudspeaker diaphragm including a nanofiber-containing coating layer and to a loudspeaker including the diaphragm. The disclosure further relates to an electronic device and a mobile device, both of which include the diaphragm.

BACKGROUND ART

Conventional loudspeaker diaphragms include a base layer and a coating layer. The base layer is made of paper made from, for example, natural fibers, such as wood-based pulp.

The coating layer is formed on one side of the base layer. The coating layer contains bacterial cellulose, which is produced by a fermentation method using bacteria. Examples of the bacteria known to produce cellulose include *Diplodia natalensis, Actinomucor elegans*, and *Rhizopus oligosporus*.

The coating layer is formed by applying a bacterial cellulose dispersion liquid to the base layer and then drying it.

An example of a conventional technique related to the invention of the present application is shown in Patent Literature 1.

CITATION LIST

Patent Literature

PTL 1: Japanese Unexamined Patent Application Publication No. H05-007393

SUMMARY OF THE INVENTION

The loudspeaker diaphragm according to the present disclosure includes a base layer and a coating layer. The base layer contains natural fibers. The coating layer contains bamboo cellulose nanofibers and is formed at least on the first side of the base layer. The coating layer has a thickness in the range of 3% to 15%, both inclusive of the sum of the thicknesses of the base layer and the coating layer.

The loudspeaker of the present disclosure includes a frame, the above-mentioned loudspeaker diaphragm, a voice coil body, and a magnetic circuit. The frame has a hollow. The loudspeaker diaphragm is located in the hollow of the frame and is connected to the frame. The voice coil body has a first end and a second end. The first end is connected to the center of the diaphragm. The magnetic circuit fixed to the frame and has a magnetic gap into which the second end of the voice coil body is inserted.

The electronic device of the present disclosure includes the above-mentioned loudspeaker and a signal processing part. The signal processing part is electrically connected to the voice coil body and supplies sound signals to the voice coil body.

The mobile device of the present disclosure includes a body, a drive part, a signal processing part, and the above-mentioned loudspeaker. The frame is fixed to the body. The drive part is mounted in the body and moves the body. The signal processing part is mounted in the body and is electrically connected to the voice coil body so as to supply sound signals to the voice coil body.

DESCRIPTION OF EMBODIMENT

It is preferable that materials used for a loudspeaker diaphragm have a high elastic modulus and an appropriate internal loss. Bacterial cellulose used for conventional diaphragms is higher than the materials of the base layer in both elastic modulus and internal loss.

Bacterial cellulose is not available enough to be stably supplied and is also expensive. Therefore, bacterial cellulose is not suitable for commercial use in spite of its good properties as a diaphragm.

To solve this problem, the present disclosure provides an inexpensive loudspeaker diaphragm that has a high elastic modulus and suppresses decrease in internal loss.

Figure 1A:
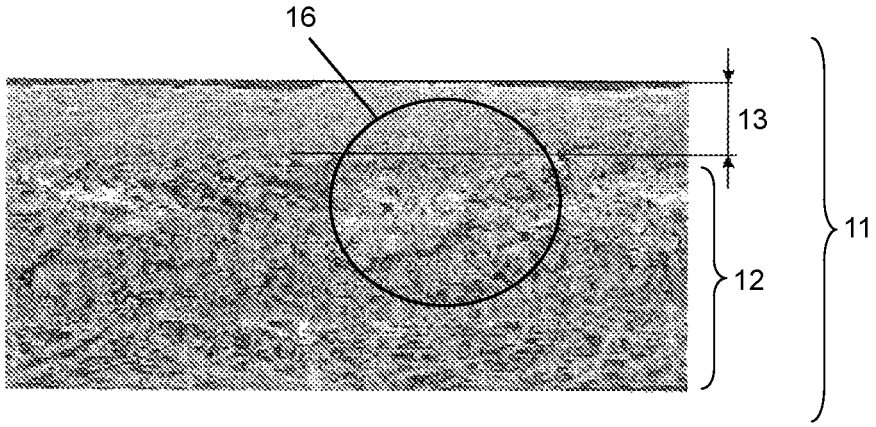
FIG. 1A shows a cross-sectional scanning electron microscope (SEM) image of a loudspeaker diaphragm according to an exemplary embodiment.
Figure 1B:
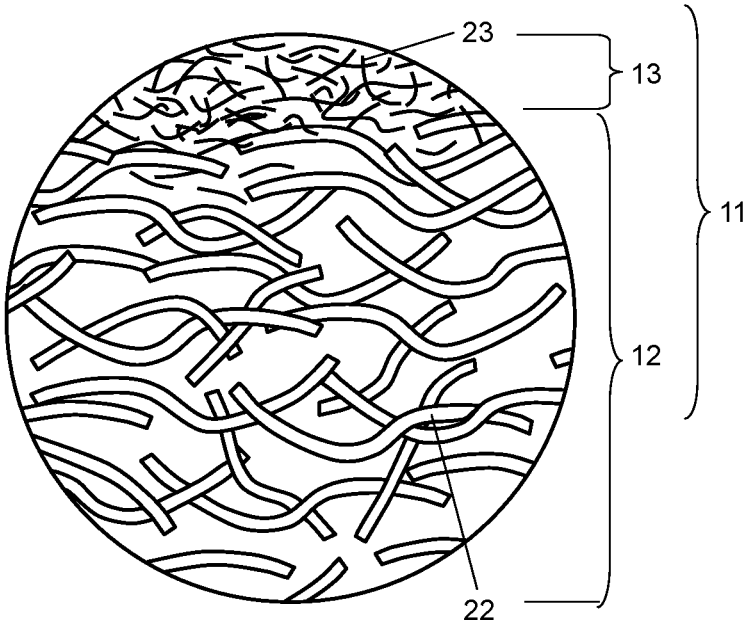
FIG. 1B is a schematic diagram of the area defined by the circle shown in FIG. 1A.
Figure 2A:
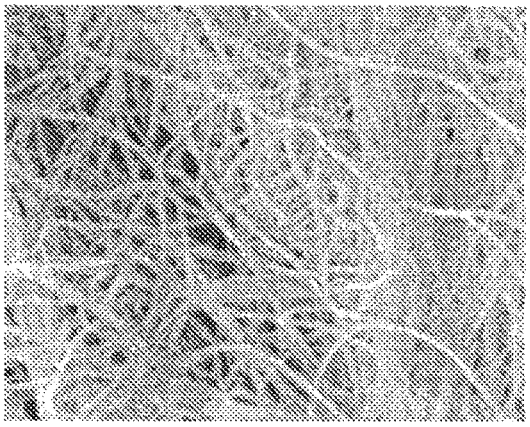
FIG. 2A shows a scanning electron microscope (SEM) image of bamboo nanofibers according to the exemplary embodiment.
Figure 2B:
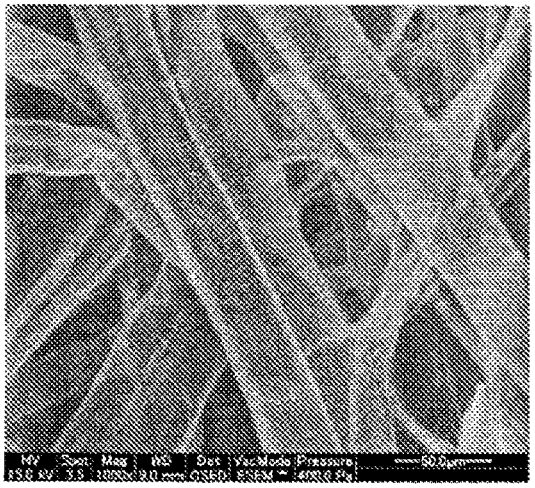
FIG. 2B shows a scanning electron microscope (SEM) image of wood pulp.

A loudspeaker component according to an exemplary embodiment will now be described with reference to drawings. The loudspeaker component is, for example, loudspeaker diaphragm 11 (hereinafter, diaphragm 11). FIG. 1A shows a cross-sectional scanning electron microscope (SEM) image of diaphragm 11 according to the exemplary embodiment. FIG. 1B is a schematic diagram of the area defined by circle 16 shown in FIG. 1A. FIG. 2A shows a scanning electron microscope (SEM) image of bamboo nanofibers used in the exemplary embodiment. FIG. 2B shows a scanning electron microscope (SEM) image of wood pulp.

The SEM images are preferably shown at about 100-fold magnification to observe the entire diaphragm 11 in the thickness direction and at about 300-fold magnification to observe coating layer 13.

Diaphragm 11 includes base layer 12 and coating layer 13. Base layer 12 contains natural fibers 22. Coating layer 13 contains bamboo cellulose nanofibers 23 and is formed at least on a first side of base layer 12. Coating layer 13 has a thickness in the range of 3% to 15%, both inclusive of the sum of the thicknesses of base layer 12 and coating layer 13.

Diaphragm 11 will now be described in detail as follows. Base layer 12 is mainly composed of natural fibers 22, which contain cellulose. Natural fibers 22 can be made, for example, of wood pulp (see FIG. 2B), non-wood pulp, or a combination thereof. The non-wood pulp used as base layer 12 preferably consists of bamboo fibers. The reason for this is that bamboos grow fast enough not to deplete forest resources. This allows diaphragm 11 to contribute to reducing global environmental damage.

Coating layer 13 is formed at least on one side (first side) of base layer 12. Coating layer 13 is mainly composed of bamboo cellulose nanofibers 23, which are cellulose-containing nano-level fibers (see FIG. 2A). Base layer 12 and coating layer 13 are firmly bonded together when both of them are made from bamboo fibers. In other words, base layer 12 and coating layer 13 are firmly bonded together when both of them contain cellulose because of hydrogen bonding between the cellulose fibers and the anchor effect provided by the entanglement of the cellulose fibers.

Bamboo cellulose nanofibers 23 preferably have diameters (fiber diameters) in the range of about 4 nm to about 200 nm, both inclusive when measured by SEM observation. The fiber diameters of bamboo cellulose nanofibers 23 are more preferably in the range of about 4 nm to about 40 nm, both inclusive. With this range, a strong anchor effect can be provided by the entanglement of bamboo cellulose nanofibers 23.

Bamboo cellulose nanofibers 23 have a higher elastic modulus than natural fibers 22 have, or in other words, than base layer 12 has. Thus, the elastic modulus of coating layer 13 is higher than that of base layer 12.

The high elastic modulus of bamboo cellulose nanofibers 23 allows coating layer 13 to have high stiffness and small thickness at the same time. As a result, coating layer 13 functions to prevent decrease in internal loss of diaphragm 11.

Coating layer 13 is made from cellulose nanofibers, which are comparatively inexpensive. As a result, diaphragm 11 has a high elasticity and an appropriate internal loss and is also inexpensive.

In loudspeaker 51 (see FIG. 7), coating layer 13 is preferably formed on the side of diaphragm 11 which is opposite to the side facing magnetic circuit 53. In other words, coating layer 13 is preferably formed on the front side of base layer 12. In this configuration, coating layer 13 formed on the front side of base layer 12 makes diaphragm 11 shiny and beautiful without applying a laminated film or the like to the front side of diaphragm 11. Diaphragm 11 can also be lighter in weight than in the case of applying a laminated film. In addition, diaphragm 11 has a higher acoustic velocity (see FIG. 3) due to coating layer 13.

Bamboo cellulose nanofibers 23 in coating layer 13 have a high density, or in other words, have small gaps between them. With this configuration, coating layer 13 prevents infiltration of water into base layer 12. Therefore, in general use, diaphragm 11 does not necessarily have to be subjected to waterproof treatment. Even in the case of being subjected to such treatment, diaphragm 11 needs only a thin waterproof membrane. As a result, diaphragm 11 can be lighter in weight and have a higher acoustic velocity than in the case of being subjected to a general waterproof treatment.

Coating layer 13 is not necessarily formed on the front side of base layer 12. It may alternatively be formed on the back side of layer 12 or on both the front and the back sides. To achieve the above-described waterproofing effect, however, coating layer 13 needs to be formed at least on the front side of base layer 12.

Diaphragm 11 may have a dust cap (not shown). The loudspeaker component only has to be a vibration-related component, instead of diaphragm 11. Examples of such component include the bobbin of the voice coil body, a coupling cone, a dust cap, a side cone, and other accessories attached to diaphragm 11.

Figure 3:
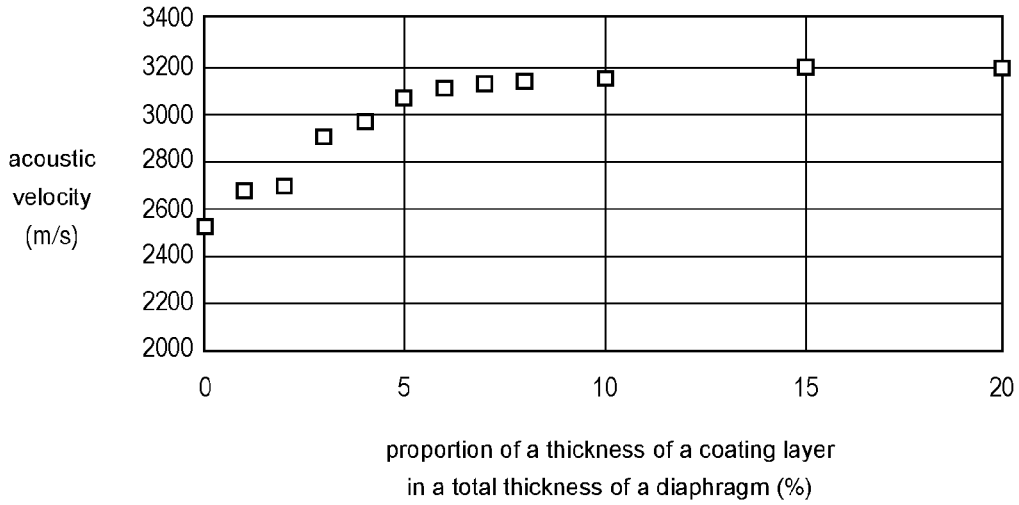
FIG. 3 is a graph showing the acoustic velocity characteristics of the loudspeaker diaphragm according to the exemplary embodiment.
Figure 4:
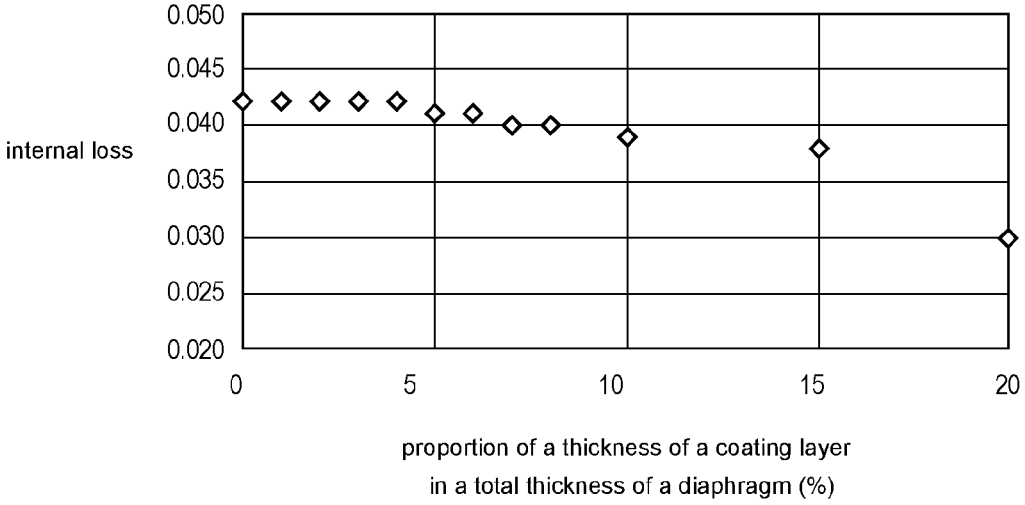
FIG. 4 is a graph showing the internal loss of the loudspeaker diaphragm according to the exemplary embodiment.

Diaphragm 11 will now be described in detail. FIG. 3 is a graph showing the acoustic velocity characteristics of diaphragm 11. FIG. 4 is a graph showing the internal loss of diaphragm 11. In FIGS. 3 and 4, the horizontal axis represents the proportion of the thickness of coating layer 13 in the total thickness of diaphragm 11. The term "total thickness" here means the sum of the thicknesses of base layer 12 and coating layer 13. The vertical axis in FIG. 3 represents the acoustic velocity of diaphragm 11, and the vertical axis in FIG. 4 represents the internal loss at 20° C. in diaphragm 11. The total thickness of diaphragm 11 and the thickness of coating layer 13 are measured by SEM observation. The total thickness of diaphragm 11 is measured at 100-fold magnification, whereas the thickness of coating layer 13 is measured at 300-fold magnification.

As shown in FIG. 3, providing coating layer 13 increases the acoustic velocity of diaphragm 11. The growth rate of the acoustic velocity, however, decreases when the thickness of coating layer 13 is 3% or more of the total thickness of diaphragm 11. Meanwhile, when the thickness of coating layer 13 is 10% or more of the total thickness of diaphragm 11, the growth in the acoustic velocity is almost saturated and stabilized.

On the other hand, when the thickness of coating layer 13 is 15% or less of the total thickness of diaphragm 11 as shown in FIG. 4, diaphragm 11 has a small decrease in internal loss. Moreover, when the thickness of coating layer 13 is 15% or less of the total thickness of diaphragm 11, diaphragm 11 is unlikely to be deformed. It is, therefore, preferable that the thickness of coating layer 13 be in the range of 3% to 15%, both inclusive of the thickness of diaphragm 11. With this configuration, diaphragm 11 has a high elastic modulus, a high acoustic velocity, and can suppress decrease in internal loss. Coating layer 13 is defined by thickness in the present embodiment, but this is not the only option available. For example, coating layer 13 may be defined by weight relative to the total weight of diaphragm 11. In this case, the weight of coating layer 13 is preferably in the range of 6 wt % to 26 wt %, both inclusive of the total weight of diaphragm 11. Coating layer 13 may further alternatively be defined by specific gravity, areal density, or other factors. The ranges of specific gravity and areal density can be calculated from the values of thickness or weight.

In the case that the thickness of coating layer 13 is 10% or less of the total thickness of diaphragm 11, diaphragm 11 has a very small change in internal loss. Therefore, the thickness of coating layer 13 is more preferably 10% or less of the thickness of diaphragm 11. With this configuration, diaphragm 11 has a higher elastic modulus, a higher acoustic velocity, and can suppress decrease in internal loss.

In this case, it is preferable that the internal loss of bamboo cellulose nanofibers 23 be 70% or more of that of natural fibers 22. Even when the internal loss of bamboo cellulose nanofibers 23 is lower than that of natural fibers 22, the internal loss of diaphragm 11 can be prevented from decreasing.

Table 1 shows the values of the elastic modulus and of the internal loss for bamboo cellulose nanofibers 23, bacterial cellulose, and typical wood-based natural pulp. As shown in Table 1, bamboo cellulose nanofibers 23 have a higher elastic modulus than the bacterial cellulose and the wood-based natural pulp. The internal loss of bamboo cellulose nanofibers 23 is 70% or more of that of the typical wood-based natural pulp.

TABLE 1

| | elastic modulus (MPa) | internal loss |
|---|---|---|
| bamboo cellulose nanofibers | 13000 | 0.03 |
| bacterial cellulose | 9500 | 0.03 |
| wood-based natural pulp | 2525 | 0.04 |

Bamboo cellulose nanofibers 23 are bamboo fibers reduced to nano level. Bamboos from which bamboo cellulose nanofibers 23 are obtained grow around the world and also grow fast. Bamboo fibers therefore are easily available. Furthermore, the process of reducing bamboo fibers to nano level can be achieved by utilizing most of the process of reducing them to the microfibrillar state. This reduces the introduction of new facilities. In addition, unlike bacterial cellulose, bamboo cellulose nanofibers 23 can be produced without culturing bacteria. This allows bamboo cellulose nanofibers 23 to be produced with higher productivity, and hence, to be much less expensive than the bacterial cellulose.

Figure 5:
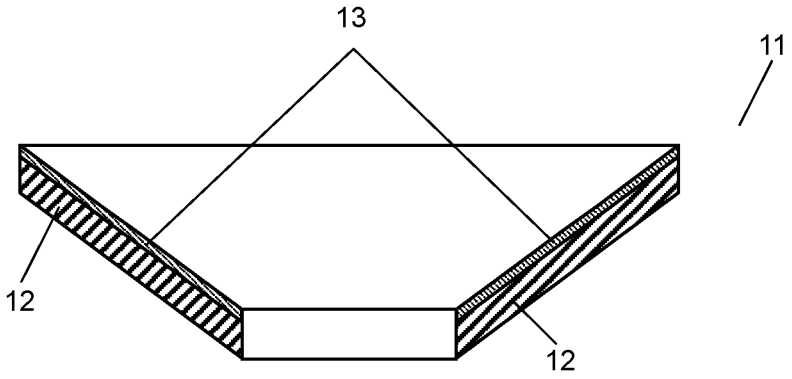
FIG. 5 is a schematic cross-sectional view of the loudspeaker diaphragm according to the exemplary embodiment.

A method of manufacturing diaphragm 11 will now be described as follows. FIG. 5 is a schematic cross-sectional view of diaphragm 11. Base layer 12 is formed from paper by depositing a mixture of beaten natural fibers 22 and water on a net. After this, bamboo cellulose nanofibers 23 are applied to the deposit containing base layer 12. Bamboo cellulose nanofibers 23 are previously mixed with water. The deposit and nanofibers 23 are then dewatered by suction or other means. The laminated body of the dewatered natural fibers and nanofibers 23 is heat-dried and press-formed into shape. Through these processes, diaphragm 11 is completed in which coating layer 13 made of bamboo cellulose nanofibers 23 is formed on base layer 12.

In this case, bamboo cellulose nanofibers 23 are applied while the deposit composing base layer 12 is in wet condition. This facilitates strong hydrogen bonding between the cellulose of bamboo cellulose nanofibers 23 and the cellulose of natural fibers 22. As a result, diaphragm 11 has a high elastic modulus.

Coating layer 13 is formed by applying bamboo cellulose nanofibers 23 to the deposit that has not been dewatered as described above. However, forming coating layer 13 is not limited in this manner. For example, coating layer 13 may alternatively be formed by applying a solution having bamboo cellulose nanofibers 23 dispersed therein to a dewatered deposit. In this case, the dewatered deposit still contains some water. Therefore, this can also facilitate strong hydrogen bonding between the cellulose of the cellulose nanofibers and the cellulose of the natural fibers.

Further alternatively, base layer 12 may be formed by previously heating and pressing the dewatered deposit. In this case, bamboo cellulose nanofibers 23 are applied to base layer 12 that has been dried and formed into shape. After this, the applied bamboo cellulose nanofibers 23 are dried. Dried base layer 12 is unlikely to break and can be produced with high productivity.

Figure 6:
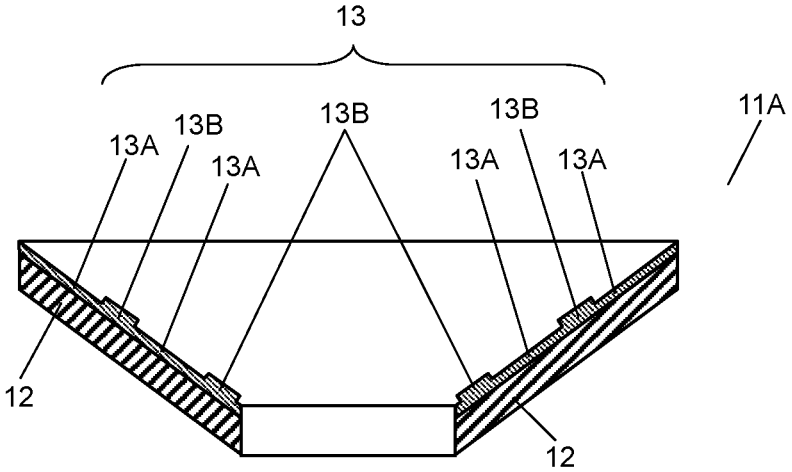
FIG. 6 is a schematic cross-sectional view of another loudspeaker diaphragm according to the exemplary embodiment.

FIG. 6 is a schematic cross-sectional view of diaphragm 11A as another diaphragm according to the exemplary embodiment. In diaphragm 11A, coating layer 13 includes first coating part 13A and second coating part 13B, which is thicker than first coating part 13A. Second coating part 13B is preferably formed in a region where diaphragm 11A may have split resonance. With this configuration, diaphragm 11A has high strength in second coating part 13B, thereby reducing the occurrence of split resonance. As a result, diaphragm 11A has fewer peaks and dips in the sound pressure frequency characteristics. The term "peak" is a band where the sound pressure level suddenly rises in the sound pressure frequency characteristics, whereas the term "dip" is a band where the sound pressure level suddenly falls in the sound pressure frequency characteristics.

Figure 7:
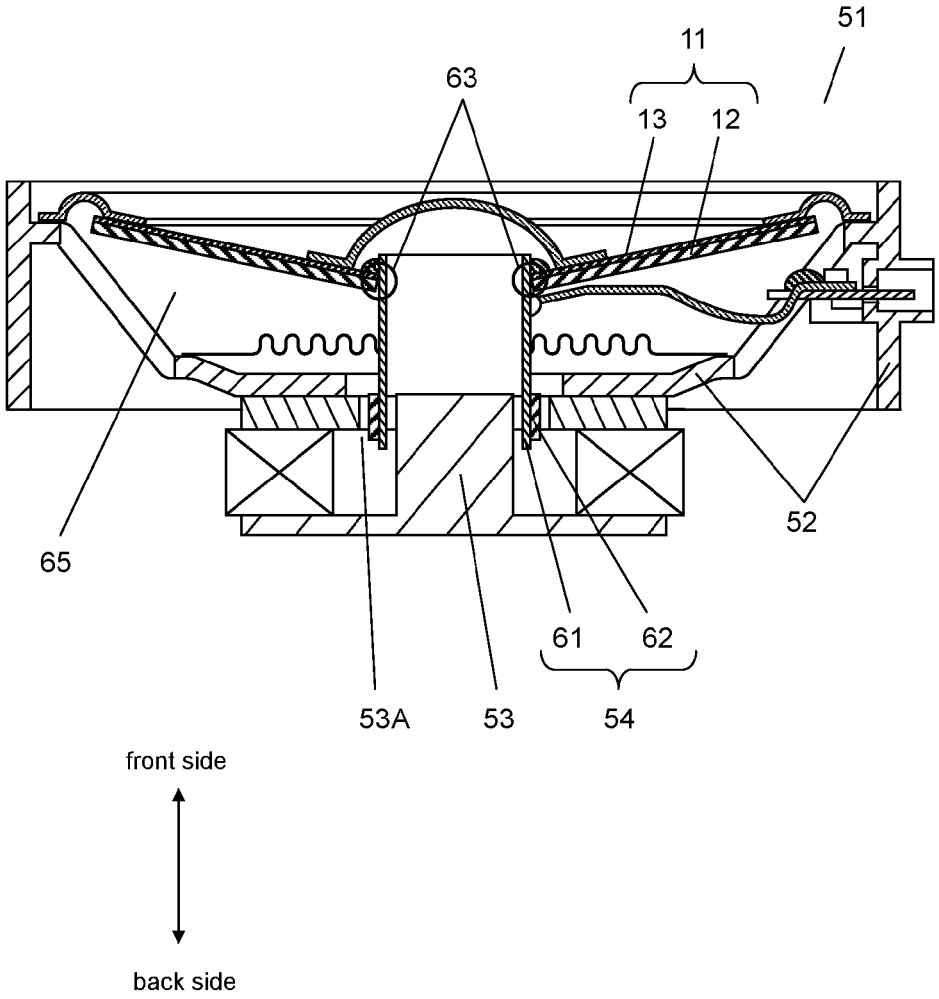
FIG. 7 is a partial sectional view of a loudspeaker according to the exemplary embodiment.

FIG. 7 is a partial sectional view of loudspeaker 51 according to the exemplary embodiment. Loudspeaker 51 includes frame 52, magnetic circuit 53, voice coil body 54, and diaphragm 11. Magnetic circuit 53 has magnetic gap 53A. Circuit 53 is fixed to frame 52 by being connected to the back side of the center of frame 52. Frame 52 has hollow 65. Diaphragm 11 is located in hollow 65 of frame 52. Diaphragm 11 and frame 52 are connected together at their respective outer peripheral portions. These outer peripheral portions may be connected by an edge. Voice coil body 54 includes bobbin 61 and voice coil 62. Bobbin 61 has a first end connected to the center of diaphragm 11 and a second end inserted into magnetic gap 53A.

Since diaphragm 11 has a high elasticity and a high acoustic velocity as described above, loudspeaker 51 has a wide reproduction frequency range and a high sound pressure level. Moreover, since diaphragm 11 suppresses decrease in internal loss, loudspeaker 51 has fewer peaks and dips in the sound pressure frequency characteristics. In addition, inexpensive diaphragm 11 can provide inexpensive loudspeaker 51.

It is preferable to form coating layer 13 in inner peripheral portion 63 of diaphragm 11 which is connected to the first end of voice coil body 54 (the first end of bobbin 61). This configuration provides high adhesion between base layer 12 and coating layer 13 at a region where these layers are connected to voice coil body 54. The high adhesion is achieved by the hydrogen bonding between the cellulose fibers and the anchor effect provided by the entanglement of the cellulose fibers. Thus, the vibration of voice coil body 54 is normally transmitted to diaphragm 11. Hence, loudspeaker 51 generates sound with high sound pressure levels.

It is possible to replace diaphragm 11 of loudspeaker 51 shown in FIG. 7 with diaphragm 11A shown in FIG. 6. As shown in FIG. 6, in the case that diaphragm 11 has second coating part 13B, it is preferable that second coating part 13B be formed in inner peripheral portion 63 of diaphragm 11. The first end of voice coil body 54 is preferably connected to second coating part 13B. The first end may alternatively be connected to the area of base layer 12 which corresponds to the region where second coating part 13B is formed. Providing second coating part 13B to diaphragm 11 increases the thickness of the area of diaphragm 11 which is connected to the first end of voice coil body 54. This increases the strength of the joint between diaphragm 11 and voice coil body 54. Thus, the vibration of voice coil body 54 is normally transmitted to diaphragm 11. Hence, loudspeaker 51 generates sound with high sound pressure levels.

It is preferable that coating layer 13 be formed on the front side of diaphragm 11, so that loudspeaker 51 can have a beautiful appearance.

Using diaphragm 11A instead of diaphragm 11 can reduce the occurrence of peaks and dips.

Figure 8:
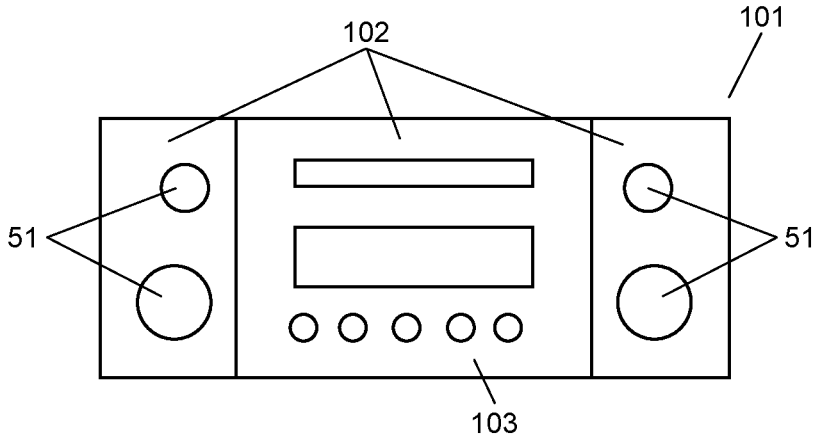
FIG. 8 is a conceptual view of an electronic device according to the exemplary embodiment.

FIG. 8 is a conceptual view of electronic device 101 according to the exemplary embodiment. Electronic device 101 includes housing 102, signal processing part 103, and loudspeaker 51. Electronic device 101 can be, for example, a stereo component system.

Signal processing part 103 is housed in housing 102 and processes sound signals. Part 103 includes an amplifier and may further include a sound source. The sound source may include, for example, one or more of the following: a CD player, an MP3 player, a radio receiver, etc.

Electronic device 101 is not limited to a stereo component system. Device 101 can alternatively be, for example, a television or other video device, a mobile phone, a smartphone, a personal computer, or a tablet terminal. In such cases, device 101 further includes a display part (not shown), and signal processing part 103 processes not only sound signals, but also video signals.

Loudspeaker 51 is fixed to housing 102. More specifically, frame 52 shown in FIG. 7 can be fixed to housing 102 via, for example, an adhesive or screws, so that loudspeaker 51 is fixed to housing 102. Housing 102 may be divided into a region in which signal processing part 103 is housed, and a loudspeaker box to which loudspeaker 51 is fixed. Alternatively, housing 102 may be integrated with signal processing part 103. Further alternatively, housing 102 may be configured to house signal processing part 103 and to fix loudspeaker 51.

Signal processing part 103 has an output terminal (not shown), which is electrically connected to loudspeaker 51. More specifically, the output terminal is electrically connected to voice coil body 54 shown in FIG. 7. As a result, signal processing part 103 can supply sound signals to voice coil body 54.

In electronic device 101, coating layer 13 is preferably formed on the front side of diaphragm 11 as shown in FIG. 7. With this configuration, the beautiful appearance of electronic device 101 is not spoiled by diaphragm 11, even if diaphragm 11 is exposed from housing 102.

Figure 9:
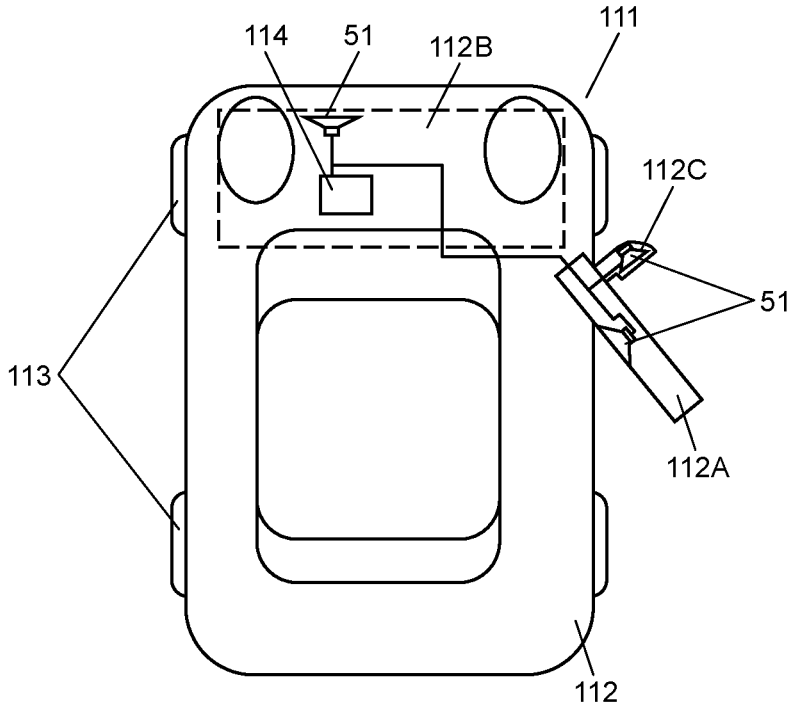
FIG. 9 is a conceptual view of a mobile device according to the exemplary embodiment.

FIG. 9 is a conceptual view of mobile device 111 according to the exemplary embodiment. Mobile device 111 includes body 112, drive part 113, signal processing part 114, and loudspeaker 51. Mobile device 111 shown in FIG. 9 is an automobile, but may alternatively be, for example, a train, a motorcycle, a ship, or other operational vehicle.

Drive part 113 is mounted in body 112. Drive part 113 may include an engine, a motor, tires, and other parts. Drive part 113 allows body 112 to move.

Signal processing part 114 is housed in body 112. Loudspeaker 51 is fixed to body 112. More specifically, frame 52 shown in FIG. 7 is fixed to body 112 via, for example, an adhesive or screws so that loudspeaker 51 can be fixed to body 112. Body 112 may include door 112A, motor compartment (or engine compartment) 112B, and side mirror 112C. Loudspeaker 51 may be housed in any of door 112A, motor compartment 112B, and side mirror 112C.

Signal processing part 114 has an output terminal (not shown), which is electrically connected to loudspeaker 51. More specifically, the output terminal is electrically connected to voice coil body 54 shown in FIG. 7. Signal processing part 114 may be part of a car navigation system or a car audio system. Alternatively, loudspeaker 51 may be part of a car navigation system or a car audio system.

In mobile device 111, coating layer 13 is preferably formed on the front side of diaphragm 11 as shown in FIG. 7. With this configuration, the beautiful appearance in mobile device 111 is not spoiled by diaphragm 11 even if diaphragm 11 is exposed.

Loudspeaker 51 is likely to come into contact with rain water when housed in, for example, door 112A, motor compartment 112B, or side mirror 112C. Coating layer 13 is therefore preferably located on the front side of diaphragm 11 as shown in FIG. 7. With this configuration, coating layer 13 prevents infiltration of rain water into loudspeaker 51.

As described hereinbefore, the loudspeaker diaphragm according to the present disclosure has a high elasticity and can suppress decrease in internal loss. The loudspeaker diaphragm also has high adhesion between the base layer and the coating layer. As a result, the vibration of the voice coil body connected to the diaphragm can be normally transmitted to the diaphragm.

INDUSTRIAL APPLICABILITY

The loudspeaker diaphragm according to the present disclosure has a high elasticity and a high internal loss, thereby being useful as a loudspeaker to be mounted in an electronic device or a mobile device.

The invention claimed is:

1. A loudspeaker diaphragm comprising:

a base layer containing natural fibers; and a coating layer containing bamboo cellulose nanofibers and formed at least on a first side of the base layer, wherein the coating layer has a thickness in a range of 3% to 15%, both inclusive of a sum of thicknesses of the base layer and the coating layer, and the coating layer includes a first coating part, and a second coating part thicker than the first coating part.

2. The loudspeaker diaphragm of claim 1, wherein the cellulose nanofibers have diameters in a range of 4 nm to 200 nm, both inclusive.

3. The loudspeaker diaphragm of claim 1, wherein the coating layer has a higher elastic modulus than the base layer has.

4. The loudspeaker diaphragm of claim 1, further comprising an inner peripheral portion and an outer peripheral portion, wherein the coating layer is formed in the inner peripheral portion.

5. The loudspeaker diaphragm of claim 1, further comprising an inner peripheral portion and an outer peripheral portion, wherein the second coating part is formed in the inner peripheral portion.

6. A loudspeaker comprising:

a frame having a hollow;

the loudspeaker diaphragm of claim 1 located in the hollow of the frame and connected to the frame;

a voice coil body having a first end and a second end, the first end being connected to a center of the loudspeaker diaphragm; and a magnetic circuit fixed to the frame and having a magnetic gap into which the second end is inserted.

7. The loudspeaker of claim 6, wherein the loudspeaker diaphragm has an inner peripheral portion and an outer peripheral portion;

the voice coil body is connected to the inner peripheral portion of the loudspeaker diaphragm; and the coating layer is formed in the inner peripheral portion.

8. The loudspeaker of claim 6, wherein the coating layer is formed on a side of the loudspeaker diaphragm which is opposite to a side facing the magnetic circuit.

9. The loudspeaker of claim 6, wherein the voice coil body is connected to the second coating part.

10. An electronic device comprising:

a loudspeaker including:

a frame having a hollow;

the loudspeaker diaphragm of claim 1 located in the hollow of the frame and connected to the frame;

a voice coil body having a first end and a second end, the first end being connected to a center of the loudspeaker diaphragm; and a magnetic circuit fixed to the frame and having a magnetic gap into which the second end is inserted; and a signal processing part electrically connected to the voice coil body and supplying a sound signal to the voice coil body.

11. A mobile device comprising:

a loudspeaker including:

a body;

a frame having a hollow and fixed to the body;

the loudspeaker diaphragm of claim 1 located in the hollow of the frame and connected to the frame;

a voice coil body having a first end and a second end, the first end being connected to a center of the loudspeaker diaphragm; and a magnetic circuit fixed to the frame and having a magnetic gap into which the second end is inserted;

a drive part mounted in the body and moving the body; and a signal processing part mounted in the body, the signal processing part being electrically connected to the voice coil body and supplying a sound signal to the voice coil body.

* * * * *